US007271368B2

(12) United States Patent
Yeung

(10) Patent No.: US 7,271,368 B2
(45) Date of Patent: Sep. 18, 2007

(54) ELECTRIC HAIR CURLING APPARATUS

(75) Inventor: Ki Cheung Yeung, Kowloon (HK)

(73) Assignee: Sun Lueng Electrical Mfg. Co. Ltd., Kowloon (HK)

( * ) Notice: Subject to any disclaimer, the term of this patent is extended or adjusted under 35 U.S.C. 154(b) by 64 days.

(21) Appl. No.: 11/342,116

(22) Filed: Jan. 27, 2006

(65) Prior Publication Data

US 2007/0175881 A1 Aug. 2, 2007

(51) Int. Cl.
*A45D 1/04* (2006.01)

(52) U.S. Cl. ..... 219/222; 219/225; 219/227; 132/232; 132/269

(58) Field of Classification Search ..... 219/222, 219/225, 227; 132/212, 224–225, 232, 238–240, 132/269
See application file for complete search history.

(56) References Cited

U.S. PATENT DOCUMENTS 2,514,244 A * 7/1950 Kemp ..... 132/238
3,696,820 A * 10/1972 Lara ..... 132/239
3,939,851 A * 2/1976 Parlagreco ..... 132/239
4,192,326 A * 3/1980 Klinge ..... 132/238
4,314,137 A * 2/1982 Dorn ..... 219/222
4,468,554 A * 8/1984 Andis ..... 219/222
4,469,934 A * 9/1984 Isshiki et al. ..... 219/222
4,580,585 A * 4/1986 Sapkus ..... 132/212
4,671,304 A * 6/1987 Tomohiro ..... 132/240
4,829,156 A * 5/1989 Thompson ..... 219/225
5,212,366 A * 5/1993 McDougall ..... 219/222
5,701,681 A * 12/1997 Wonka et al. ..... 34/97
6,554,000 B2 * 4/2003 Lin ..... 132/232

FOREIGN PATENT DOCUMENTS

GB 2141927 A * 1/1985

* cited by examiner

*Primary Examiner*—Tu Ba Hoang
*Assistant Examiner*—Vinod Patel
(74) *Attorney, Agent, or Firm*—William J. Sapone; Coleman Sudol Sappone P.C.

(57) ABSTRACT

An electric hair curler is disclosed as including a handle; and a heating tube engaged with the handle and having a longitudinal axis, and the heating tube is adapted to be releasably engaged with hair and is operable to heat hair engaged therewith, and the heating tube is rotatably movable relative to the handle about the longitudinal axis of the heating tube.

20 Claims, 11 Drawing Sheets

ELECTRIC HAIR CURLING APPARATUS

This invention relates to an electric hair curling apparatus, in particular such an apparatus having a surface on which hair to be heated and curled may be wound.

BACKGROUND OF THE INVENTION

An electric hair curler usually has a heating part fixedly engaged with a handle. The heating part is generally cylindrical in shape around the outer surface of which hair may be wound. The free end of hair is then held between the outer surface of the heating part and a clamp. The whole electric hair curler is rotated to curl the hair wound thereon, and thereafter activated to heat the hair.

A shortcoming with such an arrangement is that it is inconvenient for a user to rotate the whole hair curler to have his/her own hair wound thereon. In addition, during such rotation, the electric cable connected with and powering the hair curler is also twisted, which may, after repeated use, weaken the integrity and strength of the cable, including both the plastics sheath and the electrically conductive wires.

It is thus an object of the present invention to provide an electric hair curling apparatus in which the aforesaid shortcomings are mitigated, or at least to provide a useful alternative to the public.

SUMMARY OF THE INVENTION

According to the present invention, there is provided an electric hair curling apparatus including a handle member; and a heating member engaged with said handle member and having a longitudinal axis, wherein said heating member is adapted to be releasably engaged with hair and is operable to heat hair engaged therewith, and wherein said heating member is rotatably movable relative to said handle member in at least a first direction about said longitudinal axis of said heating member.

BRIEF DESCRIPTION OF THE DRAWINGS

A preferred embodiment of the present invention will now be described, by way of example only, with reference to the accompanying drawings, in which.

DETAILED DESCRIPTION OF THE PREFERRED EMBODIMENT

Figure 1:
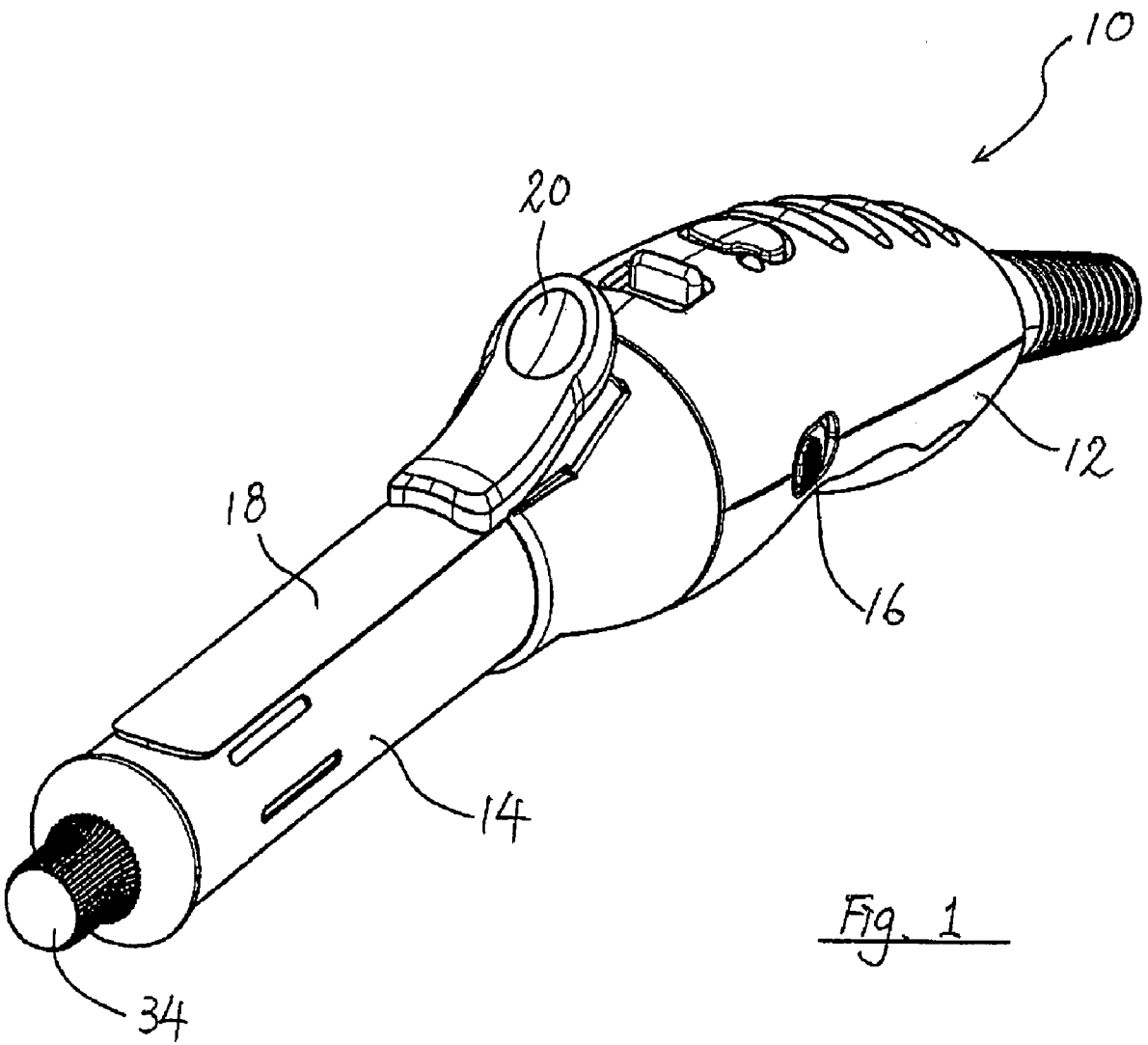
FIG. 1 is a front perspective view of an electric hair curling apparatus according to a preferred embodiment of the present invention.
Figure 2:
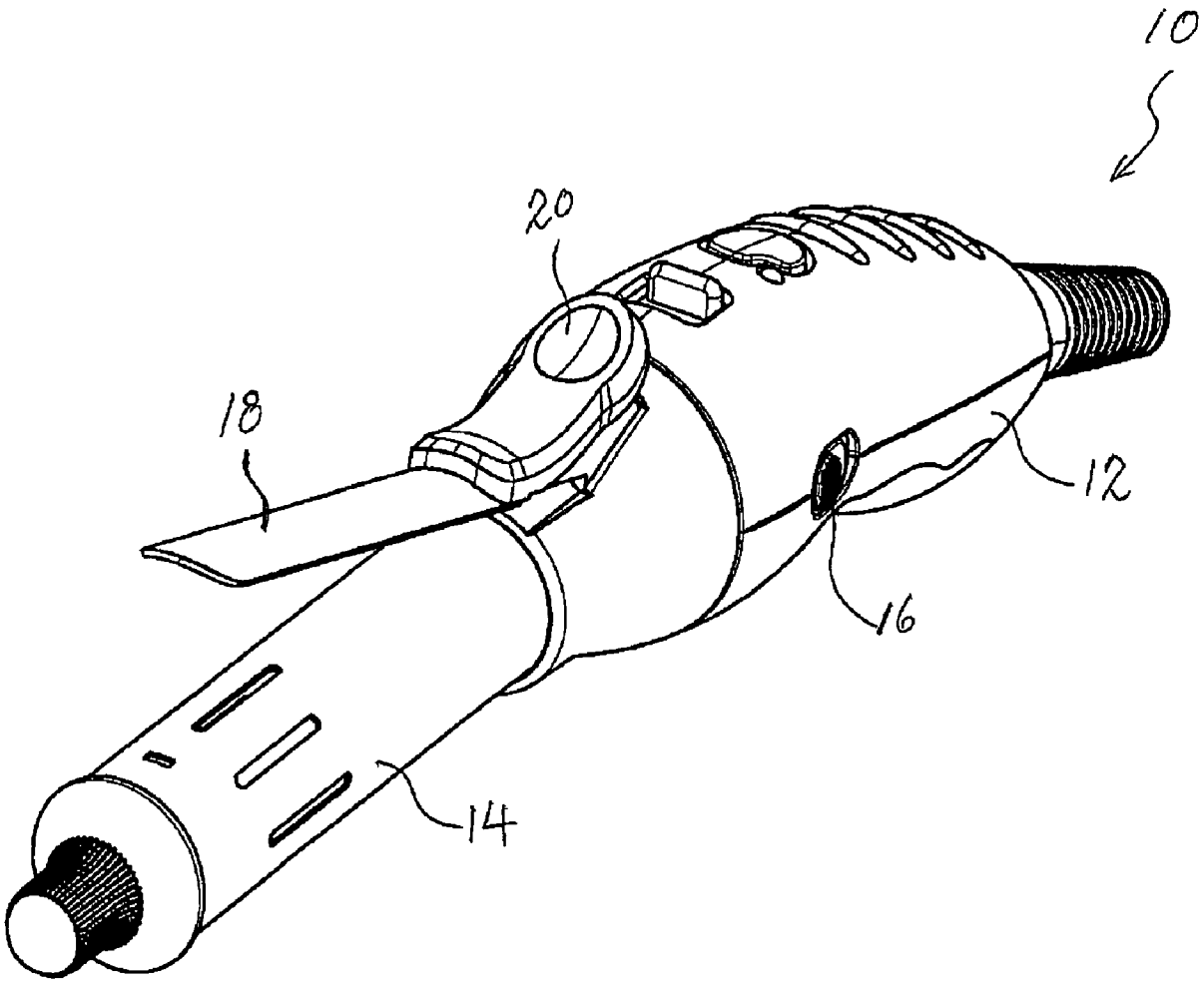
FIG. 2 is a front perspective view of the apparatus of FIG. 1 with a clamp in an open position.

An electric hair curler according to a preferred embodiment of the present invention is shown in FIGS. 1 and 2, and generally designated as 10. The hair curler 10 has a handle 12 and a heating tube 14 which are engaged with each other for relative rotational movement, in a manner to be discussed below.

The handle 12 has an ON/OFF button 16 which is movable to activate or deactivate the curler 10. As shown in FIGS. 1 and 2, the heating tube 14 is generally cylindrical in shape and around which hair may be wound. The hair is kept wound around the outer surface of the heating tube 14 by a clamp 18. The clamp 18 is spring-biased to the position as shown in FIG. 1.

In operation, a lever 20 is pressed down to raise the clamp 18 away from the heating tube 14 to allow hair to be positioned between the heating tube 14 and the clamp 18. The lever 20 is then released to return the clamp 18 to the normal position shown in FIG. 1, so as to retain the hair wound between the clamp 18 and the heating tube 14. The heating tube 14 together with the clamp 18 are then rotated relative to the handle 12 to wind the hair around the heating tube 14. After the hair is properly wound, the button 16 is pushed to the ON position to activate an electric circuit to heat up the heating tube 14, so as to heat and curl the hair. After sufficient heating and curling, the heating tube 14 and the clamp 18 are rotated relative to the handle 12 in the reverse direction to un-wind the hair. Finally, the clamp 18 is raised again from the heating tube 14 to release the hair.

Figure 3:
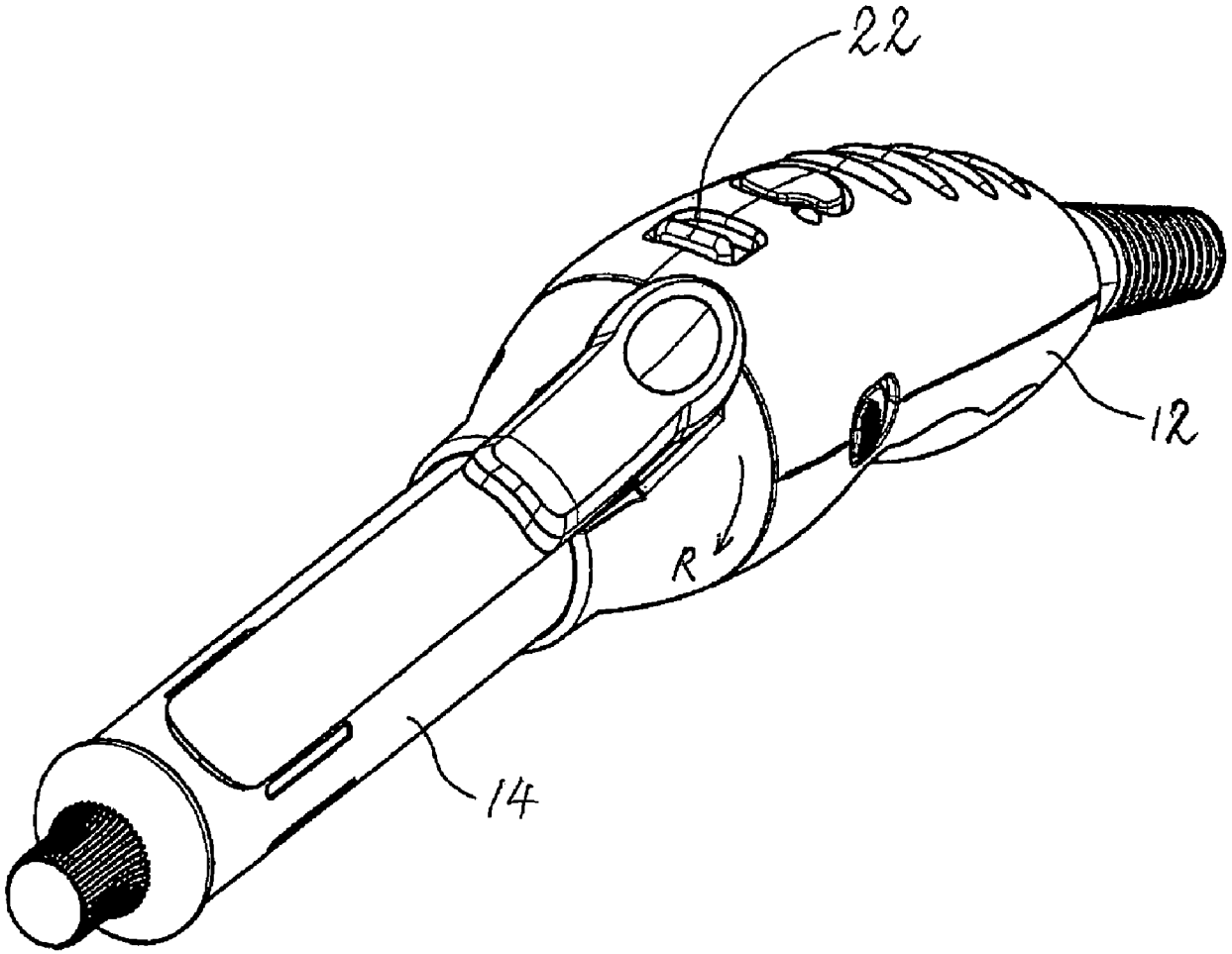
FIG. 3 is a front perspective view of the apparatus of FIG. 1, with the switch in the foremost position and the heating tube rotated in a first direction.
Figure 4:
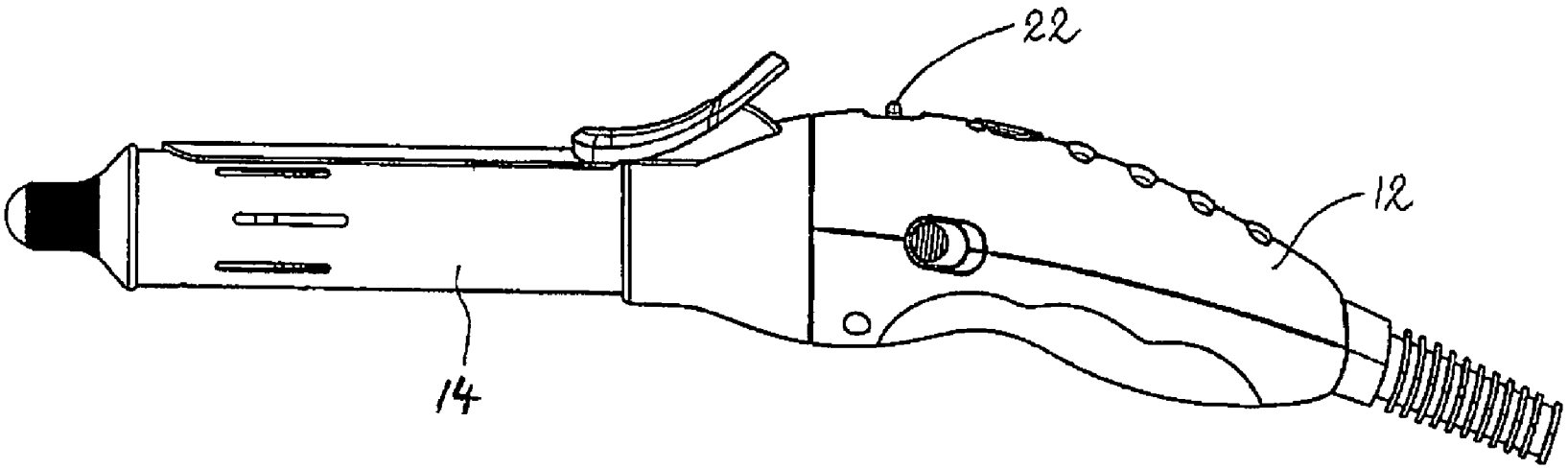
FIG. 4 is a side view of the apparatus of FIG. 1, with the switch in a middle position.
Figure 5:
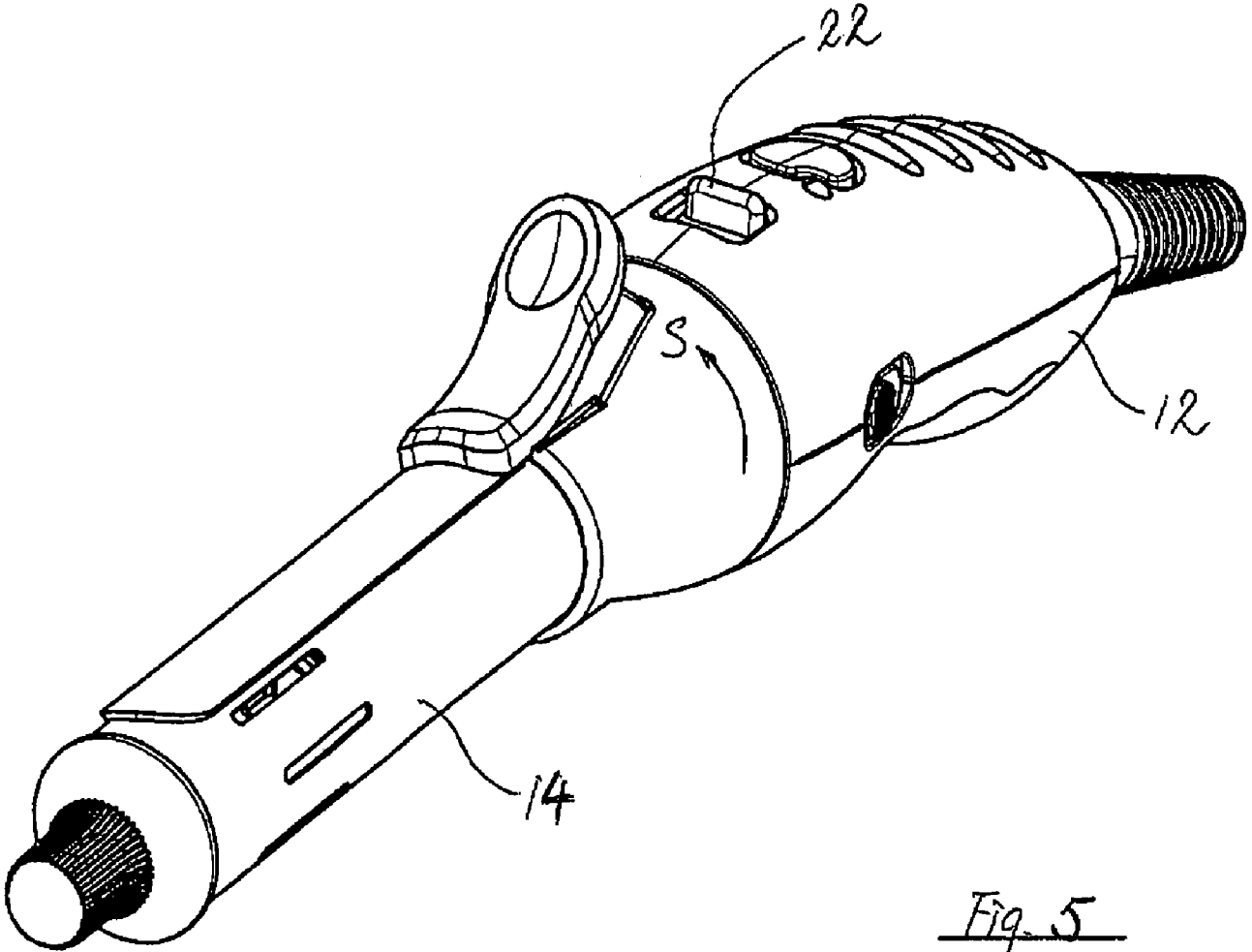
FIG. 5 is a front perspective view of the apparatus of FIG. 1, with the switch in a rearmost position and the heating tube rotated in a second direction.
Figure 6A:
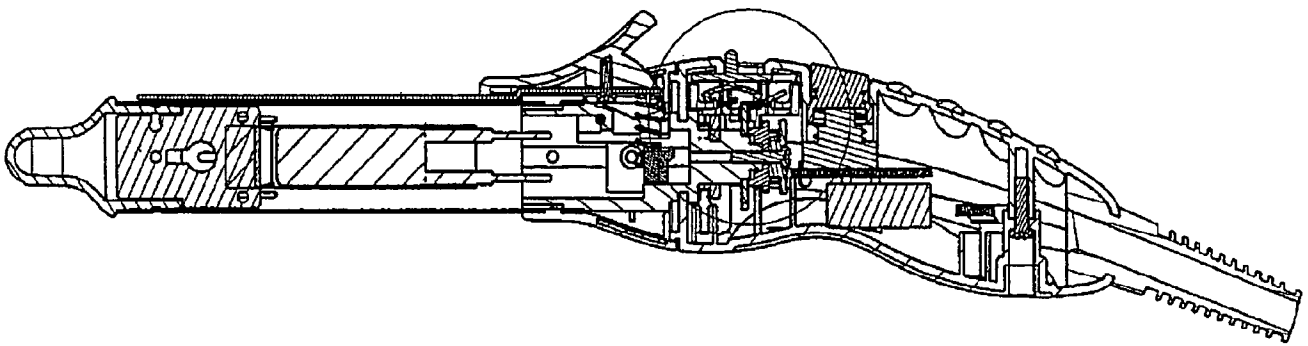
FIG. 6A is a side sectional view of the apparatus of FIG. 1 with the switch in the foremost position.
Figure 6B:
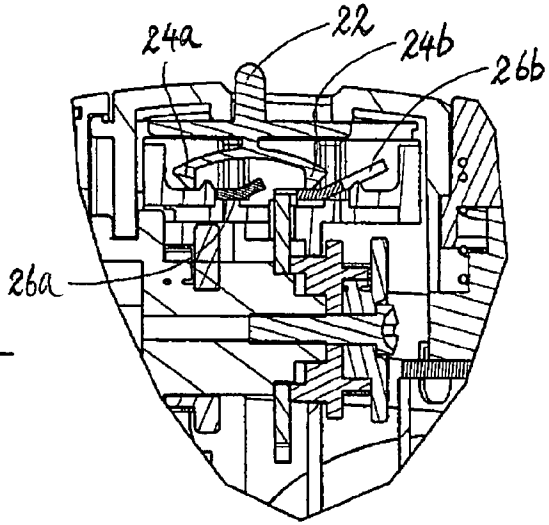
FIG. 6B is an enlarged view of the encircled part in FIG. 6A.
Figure 7A:
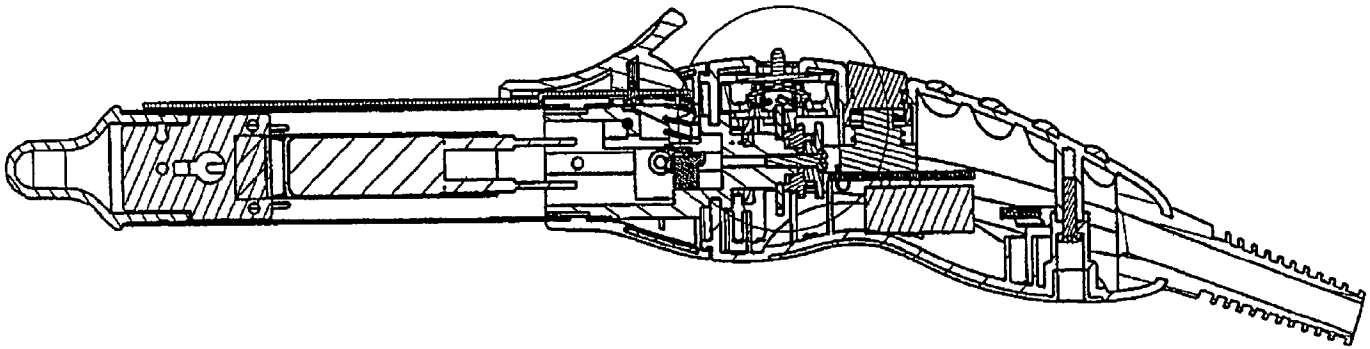
FIG. 7A is a side sectional view of the apparatus of FIG. 1 with the switch in the middle position.
Figure 7B:
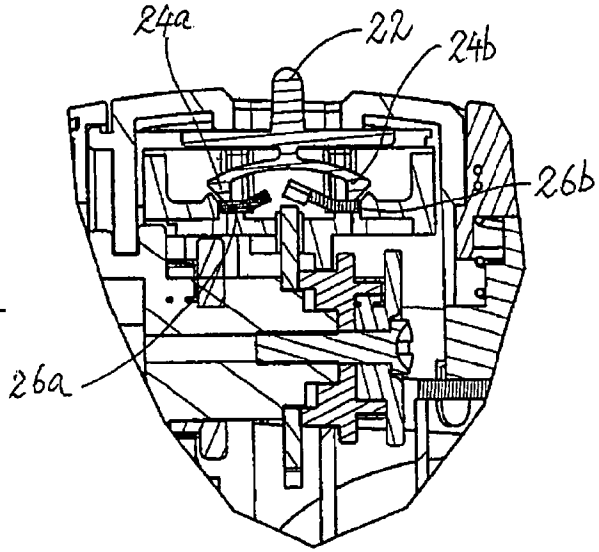
FIG. 7B is an enlarged view of the encircled part in FIG. 7A.
Figure 8B:
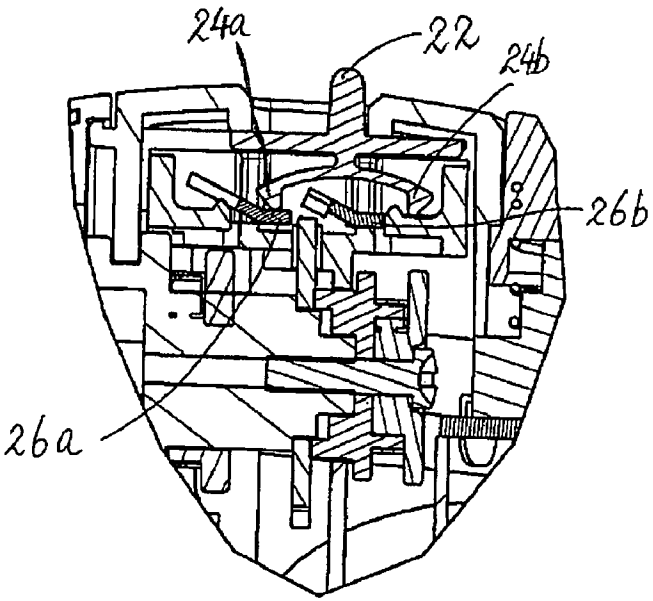
FIG. 8B is an enlarged view of the encircled part in FIG. 8A.
Figure 8A:
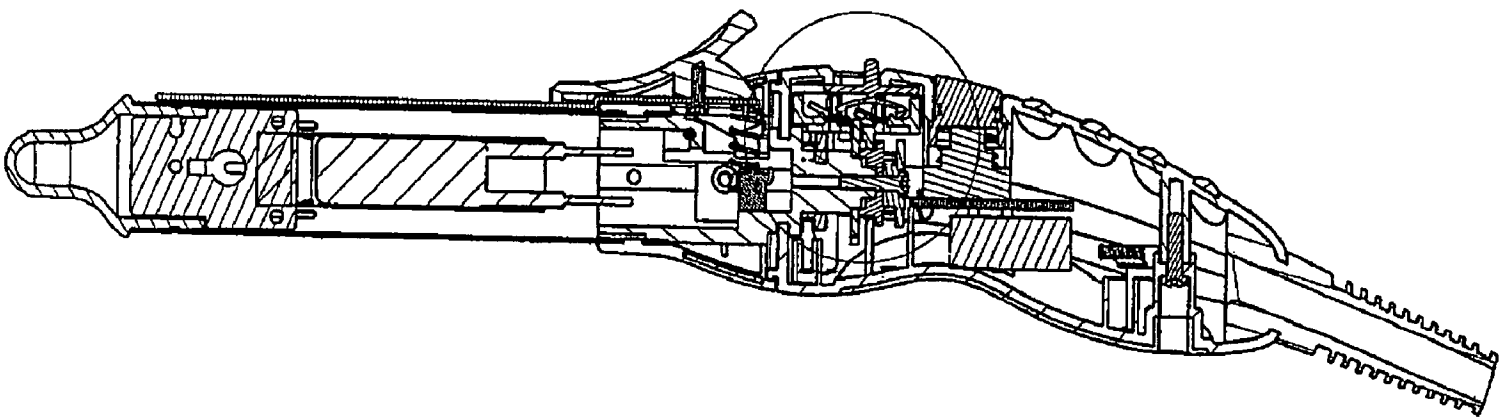
FIG. 8A is a side sectional view of the apparatus of FIG. 1 with the switch in the rearmost position.

The handle 12 also has a switch 22 which is movable among a foremost position as shown in FIG. 3, a middle position as shown in FIG. 4, and a rearmost position as shown in FIG. 5, to control the direction in which the heating tube 14 may be rotated relative to the handle 12, about the longitudinal axis of the heating tube 14. In particular, when the switch 22 is in the foremost position, as shown in FIG. 3, the heating tube 14 is rotatable relative to the handle 12 only in the direction indicated by the arrow R, but not in the opposite direction. When the switch 22 is in the rearmost position, as shown in FIG. 5, the heating tube 14 is rotatable relative to the handle 12 only in the direction indicated by the arrow S, but not in the opposite direction, i.e. the direction indicated by the arrow R in FIG. 3. When the switch 22 is in the middle position, as shown in FIG. 4, the heating tube 14 is rotatable relative to the handle 12 in both directions.

As shown in FIGS. 6A to 8B, the switch 22 has an two legs 24*a*, 24*b*, each acting on a respective ratchet stopper 26*a*, 26*b* facing each other.

Figure 9B:
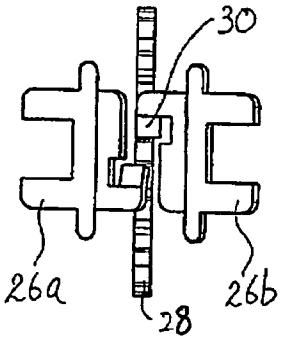
FIG. 9B is a top view of the gear and ratchet stoppers of FIG. 9A.
Figure 9C:
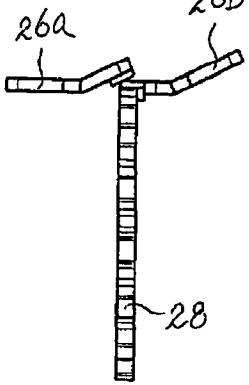
FIG. 9C is a side view of the gear and ratchet stoppers of FIG. 9A.
Figure 9A:
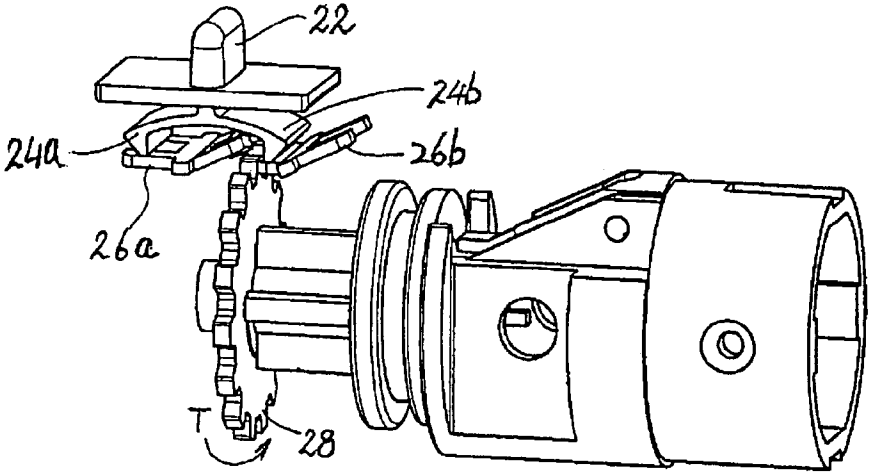
FIG. 9A is an enlarged perspective view showing the position of the gear and ratchet stoppers when the switch is in the foremost position.

As shown more clearly in FIGS. 9A to 9C, when the switch 22 is in the foremost position, the leg 24*a* acts on an outer end of the ratchet stopper 26*a*, whereby the inner end of the ratchet stopper 26*a* is raised, whereas the leg 24*b* acts on and brings down an inner end of the ratchet stopper 26*b*. The heating tube 14 is fixedly engaged with a gear 28 for simultaneous rotational movement. When the switch 22 is in this position, the ratchet stopper 26*a* is clear of the gear 28, whereas because of the resilience of an inwardly extending finger 30 of the ratchet stopper 26*b*, the gear 28 may rotate relative to the ratchet stopper 26*b* and the switch 22 in the direction indicated by the arrow T in FIG. 9A, which is the same as the direction indicated by the arrow R in FIG. 3, but not in the opposite direction.

Figure 10B:
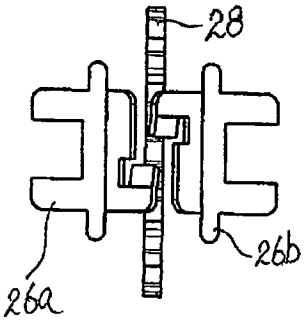
FIG. 10B is a top view of the gear and ratchet stoppers of FIG. 10A.
Figure 10C:
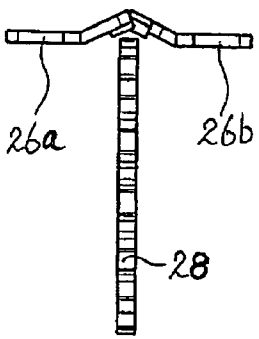
FIG. 10C is a side view of the gear and ratchet stoppers of FIG. 10A.
Figure 10A:
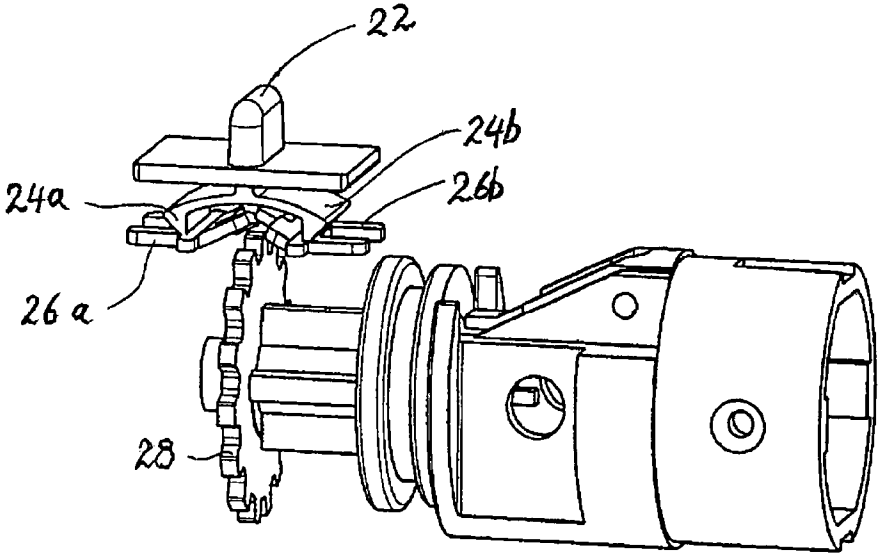
FIG. 10A is an enlarged perspective view showing the position of the gear and ratchet stoppers when the switch is in the middle position.

When the switch 22 is in the middle position, and as shown in FIGS. 10A to 10C, the legs 24*a*, 24*b* act on the respective stoppers 26*a*, 26*b* to raise their inner ends clear of the gear 28. The gear 28, and thus the heating tube 14 fixedly engaged with it, may thus rotate relative to the handle 12 about the longitudinal axis of the heating tube 14 in both directions.

Figure 11B:
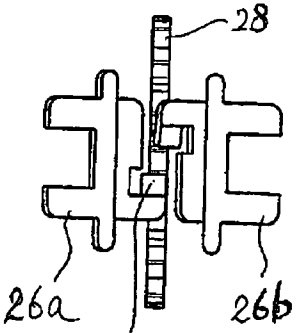
FIG. 11B is a top view of the gear and ratchet stoppers of FIG. 11A.
Figure 11C:
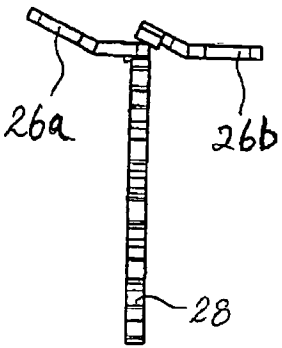
FIG. 11C is a side view of the gear and ratchet stoppers of FIG. 11A.
Figure 11A:
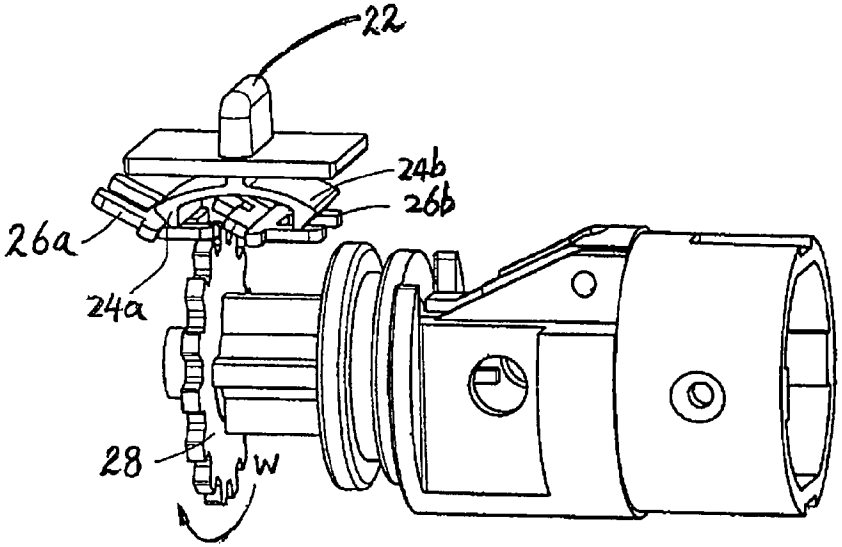
FIG. 11A is an enlarged perspective view showing the position of the gear and ratchet stoppers when the switch is in the rearmost position.

When the switch 22 is in the rearmost position, and as shown in FIGS. 11A to 11C, the leg 24*b* acts on an outer end of the ratchet stopper 26*b*, whereby the inner end of the ratchet stopper 26*b* is raised, whereas the leg 24*a* acts on and brings down an inner end of the ratchet stopper 26*a*. The ratchet stopper 26*b* is thus clear of the gear 28, and because of the resilience of an inwardly extending finger 32 of the ratchet stopper 26*a*, the gear 28 may rotate relative to the ratchet stopper 26*a* and the switch 22 in the direction indicated by the arrow W in FIG. 11A, which is the same as the direction indicated by the arrow S in FIG. 5, but not in the opposite direction.

As a user may hold both the handle 12 and the heating tube 14 for relative rotational movement during use, the user may be hurt by the hot heating tube 14 if no protection is provided. In this connection, and as shown in FIG. 1, a free longitudinal end of the heating tube 14 is fixed with a heat insulating and electrically insulating element 34 to be held by a user in use. The element 34 may be made of polybutylene terephthalate or glass-reinforced polybutylene terephthalate.

It should be understood that the above only illustrates an example whereby the present invention may be carried out, and that various modifications and/or alterations may be made thereto without departing from the spirit of the invention.

It should also be understood that various features of the invention which are, for brevity, described here in the context of a single embodiment, may be provided separately or in any appropriate sub-combinations.

The invention claimed is:

1. An electric non-motorized hair curling apparatus including:

a handle member; and a heating member engaged with said handle member and having a longitudinal axis, wherein said heating member is adapted to be releasably engaged with hair and is operable to heat hair engaged therewith, and a switch member having two legs facing each other, wherein said heating member is manually rotatably movable relative to said handle member in at least a first direction about said longitudinal axis of said heating member and a second direction about said longitudinal axis of said heating member, wherein said second direction is opposite to said first direction, said switch member being operatively associated with a first ratchet stopper and a second ratchet stopper where each of said legs releasable engaged on the respective one of said stoppers facing each other.

2. An apparatus according to claim 1 wherein said switch member is movable to a first position in which rotational movement of said heating member relative to said handle member in said first direction is allowed and rotational movement of said heating member relative to said handle member in said second direction is prevented.

3. An apparatus according to claim 1 wherein said switch member is movable to a second position in which rotational movement of said heating member relative to said handle member in said first direction and said second direction is allowed.

4. An apparatus according to claim 1 wherein said switch member is movable to a third position in which rotational movement of said heating member relative to said handle member in said first direction is prevented and rotational movement of said heating member relative to said handle member in said second direction is allowed.

5. An apparatus according to claim 1 wherein said heating member is fixedly engaged with a gear member for simultaneous rotational movement about its longitudinal axis, and wherein said gear member is operatively associated with said first and second ratchet stoppers.

6. An apparatus according to claim 5 wherein said switch member is movable to a first position in which said first ratchet stopper is clear of said gear member, whereby rotational movement of said gear member relative to said handle member in said first direction is allowed and rotational movement of said gear member relative to said handle member in said second direction is prevented by said second ratchet stopper.

7. An apparatus according to claim 5 wherein said switch member is movable to a second position in which said first and second ratchet stoppers are clear of said gear member, whereby rotational movement of said gear member relative to said handle member in said first and second directions is allowed.

8. An apparatus according to claim 5 wherein said switch member is movable to a third position in which said second ratchet stopper is clear of said gear member, whereby rotational movement of said gear member relative to said handle member in said second direction is allowed and rotational movement of said gear member relative to said handle member in said first direction is prevented by said first ratchet stopper.

9. An apparatus according to claim 1 wherein a free longitudinal end of said heating member is fixedly engaged with a holding portion adapted to be held by a user during use.

10. An apparatus according to claim 9 wherein said holding portion is made at substantially of polybutylene terephthalate or glass-reinforced polybutylene terephthalate.

11. An electric hair curling apparatus including:

a handle member; and a heating member engaged with said handle member and having a longitudinal axis, wherein said heating member is adapted to be releasably engaged with hair and is operable to heat hair engaged therewith, said heating member being rotatably movable relative to said handle member in at least a first direction about said longitudinal axis of said heating member, said heating member being rotatable relative to said handle member in a second direction about said longitudinal axis of said heating member, said second direction being opposite to said first direction; and, a switch member having two legs facing each other, the switch member movable to vary the direction in which said heating member is rotatable relative to said handle member, said switch member being operatively associated with a first ratchet stopper and a second ratchet stopper where each of said legs releasable engaged on the respective one of said stoppers facing each other.

12. An apparatus according to claim 11 wherein said switch member is movable to a first position in which rotational movement of said heating member relative to said handle member in said first direction is allowed and rotational movement of said heating member relative to said handle member in said second direction is prevented.

13. An apparatus according to claim 11 wherein said switch member is movable to a second position in which rotational movement of said heating member relative to said handle member in said first direction and said second direction is allowed.

14. An apparatus according to claim 11 wherein said switch member is movable to a third position in which rotational movement of said heating member relative to said handle member in said first direction is prevented and rotational movement of said heating member relative to said handle member in said second direction is allowed.

15. An apparatus according to claim 11 wherein said heating member is fixedly engaged with a gear member for simultaneous rotational movement about its longitudinal axis, and wherein said gear member is operatively associated with said first and second ratchet stoppers.

16. An apparatus according to claim 15 wherein said switch member is movable to a first position in which said first ratchet stopper is clear of said gear member, whereby rotational movement of said gear member relative to said handle member in said first direction is allowed and rotational movement of said gear member relative to said handle member in said second direction is prevented by said second ratchet stopper.

17. An apparatus according to claim 15 wherein said switch member is movable to a second position in which said first and second ratchet stoppers are clear of said gear member, whereby rotational movement of said gear member relative to said handle member in said first and second directions is allowed.

18. An apparatus according to claim 15 wherein said switch member is movable to a third position in which said second ratchet stopper is clear of said gear member, whereby rotational movement of said gear member relative to said handle member in said second direction is allowed and rotational movement of said gear member relative to said handle member in said first direction is prevented by said first ratchet stopper.

19. An apparatus according to claim 11 wherein a free longitudinal end of said heating member is fixedly engaged with a holding portion adapted to be held by a user during use.

20. An apparatus according to claim 19 wherein said holding portion is made at substantially of polybutylene terephthalate or glass-reinforced polybutylene terephthalate.

* * * * *

UNITED STATES PATENT AND TRADEMARK OFFICE

CERTIFICATE OF CORRECTION

PATENT NO. : 7,271,368 B2
APPLICATION NO. : 11/342116
DATED : September 18, 2007
INVENTOR(S) : Ki Cheung Yeung It is certified that error appears in the above-identified patent and that said Letters Patent is hereby corrected as shown below:

On the title page, item (73); should read:
ASSIGNEE: Sun Luen Electrical Mfg. Co. Ltd.

Signed and Sealed this
Twenty-second Day of March, 2011

David J. Kappos

David J. Kappos
*Director of the United States Patent and Trademark Office*